US005900074A

United States Patent [19]

Ishizaki et al.

[11] Patent Number: 5,900,074

[45] Date of Patent: May 4, 1999

[54] COMPOSITION AND PROCESS FOR TREATING MAGNESIUM-CONTAINING METALS AND PRODUCT THEREFROM

[75] Inventors: Sadao Ishizaki, Tochigi-Ken; Masahiko Nishida, Utsunomiya; Yokichi Sato, Kunitachi, all of Japan

[73] Assignee: Henkel Corporation, Gulph Mills, Pa.

[21] Appl. No.: 08/822,444

[22] Filed: Mar. 21, 1997

Related U.S. Application Data

[63] Continuation of application No. 08/637,635, filed as application No. PCT/US94/12193, Oct. 27, 1994, Pat. No. 5,645,650.

[30] Foreign Application Priority Data

Oct. 29, 1993 [JP] Japan ..... 5-272504

[51] Int. Cl.[6] ..... C23C 22/07

[52] U.S. Cl. ..... 148/260; 148/261; 148/262; 148/275

[58] Field of Search ..... 148/260, 261, 148/262, 275

[56] References Cited

U.S. PATENT DOCUMENTS 5,645,650 7/1997 Ishizaki et al. ..... 148/260

*Primary Examiner*—David A. Simmons
*Assistant Examiner*—Robert R. Koehler
*Attorney, Agent, or Firm*—Wayne C. Jaeschke; Norvell E. Wisdom, Jr.; Frank E. Robbins

[57] ABSTRACT

The formation on the surface of Mg-containing metal of a highly corrosion-resistant, highly rust-inhibiting, and strongly paint-adherent conversion coating, using a chromic acid free treatment bath, is achieved by treatment with a pH 2.0–5.0 aqueous bath that contains phosphoric acid, manganese ion, and amine, thereby forming a conversion coating that contains P—Mn and Mn—N and/or other nitrogen compounds.

14 Claims, No Drawings

COMPOSITION AND PROCESS FOR TREATING MAGNESIUM-CONTAINING METALS AND PRODUCT THEREFROM

CROSS-REFERENCE TO RELATED APPLICATION

This application is a continuation of copending application Ser. No. 08/637,635 filed Apr. 29, 1996, which was the U.S. National Stage of International Application PCT/US94/12193 filed Oct. 27, 1994 and designating the United States, now U.S. Pat. No. 5,645,650.

TECHNICAL FIELD

The invention relates to a conversion treatment bath composition (herein-after usually called either "bath" or "composition", either of which in this context is to be understood as meaning "bath composition") that is suitable, either as such or after dilution with water, for improving the corrosion resistance and rust-inhibiting performance of, and the adherence of paint to, the surface of magnesium-containing metals by forming a conversion coating thereon by contact at suitable temperatures for suitable times. The invention also relates to a conversion treatment method that uses this bath and to objects to which this conversion treatment has been applied.

BACKGROUND ART

The conversion treatment of magnesium-containing metals is already known, for example, from JIS H-8651, MIL-M-3171, and so forth, and these conversion treatments have found practical application as underpaint coating treatments for magnesium-containing metals. However, all of these conversion treatment baths contain hexavalent chromium ions. Since hexavalent chromium ions are a pollution source, their presence is accompanied by a number of problems, for example, processing of the effluent from conversion treatment, management of the working environment, and the like.

These conversion treatments are also subject to other problems; for example, they require high treatment temperatures and long treatment times, and their treatment baths are very concentrated. Moreover, the conversion films produced by these conversion treatments have a strong tendency to be nonuniform.

Japanese Patent Publication Number Hei 3-6994 [6,994/1991] discloses a conversion treatment for magnesium-containing metals that does not use hexavalent chromium ions. This conversion treatment takes the form of a $Cr^{6+}$-free phosphate conversion treatment, which, however, is not sufficient to provide magnesium-containing metals with corrosion resistance. Specifically, after the phosphate treatment step, the overall treatment method of Japanese Patent Publication Number Hei 3-6994 teaches treatment with silicate and then silicone. The phosphate conversion coating by itself provides only a poor corrosion resistance and adherence when applied to the surface of magnesium-containing metals as an underpaint coating treatment. This treatment method also suffers from other problems; for example, it requires a multistep treatment process, high treatment temperatures, and long treatment times.

The use of treatment baths based on zinc phosphate, iron phosphate, zirconium phosphate, and so forth, is already known within the realm of phosphate-based conversion treatment methods, but these methods essentially can not provide the surface of magnesium-containing metals with a corrosion resistance satisfactory for practical applications.

A manganese phosphate treatment is reported in Section 7 of Japanese Industrial Standards ("JIS") H-8651, but this treatment bath is unsuitable for practical applications because it uses chromium, requires high treatment temperatures of 80° C. to 90° C., and requires long treatment times of 30 to 60 minutes.

DISCLOSURE OF THE INVENTION

Problems to Be Solved by the Invention

Thus, as described above, the following problems are associated with conversion treatment methods according to the prior art for magnesium-containing metals:

1) the use of chromium, which is a typical pollution source;
2) a requirement for high treatment temperatures;
3) a requirement for long treatment times;
4) in the case of chromium-free systems, the resulting conversion coating has a corrosion resistance and paint adherence inferior to those obtained with the use of chromium;
5) management of the treatment bath is difficult, making it difficult to consistently obtain a uniform conversion coating; and
6) degradation of the working environment.

The invention was pursued in order to solve the problems listed above. The present invention takes as an object the introduction of a substantially chromium-free conversion treatment bath composition that is able to form a uniform, highly corrosion-resistant, highly rust-inhibiting, and strongly paint-adherent conversion film on the surface of magnesium-containing metals. An additional object of the invention is that said conversion film should be formed by a rapid, low-temperature, and low-cost method in which bath management is simple and which uses relatively simple equipment. Other objects of the invention are a conversion treatment method that uses said composition and magnesium-containing materials that have been conversion treated with said composition.

SUMMARY OF THE INVENTION

The aqueous liquid conversion treatment bath composition of the invention, which is intended for application to magnesium-containing metals, characteristically is an aqueous solution that has a pH of 2.0 to 5.0 and contains phosphorus-containing acid, divalent manganese ions (hereinafter usually described simply as "manganese ions"), and at least one amine. Alternative embodiments of the invention are compositions ready for use, called "working compositions", and concentrates, from which working compositions can be made by dilution with water only.

The amine compound used in the conversion treatment bath composition of the invention is preferably selected from aliphatic amine compounds, hetero-cyclic amine compounds, and aromatic amine compounds.

The conversion treatment bath composition of the invention may also contain one or more selections from the group comprising nitrate ions, sulfate ions, and fluorine-containing compounds.

The method of the invention for the conversion treatment of magnesium-containing metals characteristically consists of forming a conversion coating that contains phosphorus-manganese and manganese-nitrogen and/or other nitrogen compounds on the surface of magnesium-containing metal by contacting said magnesium-containing metal with an aqueous conversion treatment bath that has a pH of 2.0 to 5.0 and contains phosphoric acid, manganese ions, and amine (s).

Conversion-treated magnesium-containing metal in accordance with the present invention characteristically comprises a magnesium-containing metal substrate whose surface is at least partially covered with a conversion coating that contains phosphorus-manganese and manganese-nitrogen and/or other nitrogen compounds and that has been formed by contacting the surface of said substrate with an aqueous conversion treatment bath that has a pH of 2.0 to 5.0 and contains phosphorus-containing acid, manganese ions, and amine(s).

DESCRIPTION OF PREFERRED EMBODIMENTS

The conversion coatings on conversion-treated material in accordance with the invention preferably contain 1 to 500 milligrams per square meter (hereinafter usually abbreviated as "$mg/m^2$") of manganese and 1 to 1000 $mg/m^2$ of phosphorus. In addition and independently, these conversion coatings preferably contain a large number of reticulating cracks having widths of 0.1 to 2 micrometers.

Magnesium-containing metals encompassed by the invention include pure magnesium and alloys containing at least 50 % magnesium, for example, is Mg—AI—Zn alloys, Mg—Zn alloys, Mg—Al—Zn—Mn alloys, and the like. The magnesium containing metals preferably contain, with increasing preference in the order given, at least 55, 65, 75, 80, 85, 90, or 95 % by weight of magnesium.

The phosphorus-containing acid used in the invention preferably comprises at least one selection from metaphosphoric acid, orthophosphoric acid, condensed densed phosphoric acids, phosphorous acid, hypophosphorous acid, and the like; the use of orthophosphoric acid is most preferred. The phosphorus-containing acid also functions as etchant for the magnesium-containing metal and is thus effective for the actual production of the conversion coating. The concentration in working baths of phosphorus from these free acids and/or anions derivable by ionization of these acids, including any phosphorus containing anions added to the baths in the form of salts, preferably is, with increasing preference in the order given, at least 0.01, 0.02, 0.04, 0.08, 0.16, 0.20, 0.24, 0.28, 0.32, 0.34, 0.35, 0.36, or 0.37 gram-atoms per liter (hereinafter usually abbreviated "g-a/L") and independently preferably is, with increasing preference in the order given, not more than 1.2, 1.0, 0.90, 0.80, 0.70, 0.65, 0.60, 0.58, 0.56, 0.55, 0.54, or 0.53 g-a/L.

Manganese ions can be supplied by, for example, manganese dihydrogen phosphate, $Mn(H_2PO_4)_2 \cdot 4H_2O$; manganese hydrogen phosphate, $MnHPO_4 \cdot ,H_2O$; manganese nitrate, $Mn(NO_3)_2 \cdot xH_2O$; manganese sulfate, $MnSO_4 \cdot H_2O$ ); manganese fluoborate, $Mn(BF_4)_2 \cdot 6H_2O$; manganese carbonate, $MnCO_3$; and the like. Generally, in order to keep the composition of the treatment bath according to the invention as simple as possible, the use of one or more of the above noted manganese orthophosphate salts is preferred, because this leads to preferred ratios between manganese and phosphorus contents and provides a buffering action that helps maintain the pH of the composition within the desired range. The manganese ions are believed to be the source of the manganese compound present in the conversion coating formed on the surface of the magnesium-containing metal treated according to the invention. The manganese ions therein are believed to act to provide the conversion coating with an excellent corrosion resistance and rust inhibition and to improve the paint adherence. The concentration of manganese ions (assuming total ionization of any manganese salts present) in working baths according to the invention preferably is, with increasing preference in the order given, at least 0.005, 0.008, 0.016, 0.030, 0.040, 0.050, 0.055, 0.060, 0.065, 0.068, 0.072, 0.074, 0.075, 0.076, or 0.077 g-a/L and independently preferably is, with increasing preference in the order given, not more than 1.0, 0.5, 0.4, 0.30, 0.25, 0.20, 0.18, 0.16, 0.14, 0.13, 0.12, or 0.11 g-a/L. Independently, the ratio of the concentration in g-a/L of manganese to that of phosphorus preferably is, with increasing preference in the order given, at least 0.02, 0.04, 0.08, 0.10, 0.12, 0.14, 0.16, 0.18, 0.19, or 0.20 and independently preferably is, with increasing preference in the order given, not more than 1.0, 0.7, 0.50, 0.40, 0.35, 0.30, 0.28, 0.27, 0.26, 0.25, 0.24, 0.23, or 0.22. These ratios, unlike the absolute concentration values given above, apply to concentrates as well as to working baths.

The concentration in working treatment baths according to the invention of the amine component preferably is, with increasing preference in the order given, at least 0.01, 0.020, 0.030, 0.050, 0.070, 0.090, 0.110, 0.130, 0.150, 0.170, 0.180, 0.185, or 0.190 gram moles per liter (hereinafter usually abbreviated "molar" or "M") and independently preferably is, with increasing preference in the order given, not more than 1.0, 0.90, 0.80, 0.70, 0.60, 0.50, 0.40, 0.320, 0.280, 0.260, 0.240, 0.230, 0.220, 0.210, or 0.200M. Also independently, for both concentrates and working baths, the ratio of the total molar concentration of amine to the concentration of manganese in gall as defined above preferably is, with increasing preference in the order given, at least 0.2, 0.4, 0.6, 0.8, 1.0, 1.20, 1.30, 1.40, 1.50, 1.60, 1.70, 1.80, 1.90, 2.00, 2.10, 2.20, 2.30, or 2.40 and independently preferably is, with increasing preference in the order given, not more than 5.0, 4.5, 4.0, 3.5, 3.2, 3.0, 2.9, 2.8, 2.7, 2.6, or 2.5.

The amine component used by the present invention is preferably selected from those aliphatic amine compounds, heterocyclic amine compounds, and aromatic amine compounds that are soluble in an aqueous solution at. pH 2.0 to 5.0 and at a temperature of 25° C. to an extent of at least, with increasing preference in the order given, 10, 9, 8, 7, 6, 5, 4, 3, 2, 1.0, 0.8, 0.6, 0.5, or 0.4% by weight. Aliphatic amine compounds of this type are exemplified by propylamine, diethylamine, and triethylamine. The heterocyclic amines and aromatic amines that fall into this category are exemplified by triazole and aniline, respectively. Triethylamine is particularly preferred.

The presence of an amine component in the treatment bath composition is a crucial feature of the present invention. The presence of amine compound in a conversion treatment bath that contains phosphoric acid and manganese ion is believed to serve to prevent excessive etching of the surface of magnesium-containing metal. The resulting optimal etch makes possible the reliable production of a product that has the excellent corrosion resistance, rust inhibition, and adherence desired of an undercoating composition for application with paints and synthetic organic resins.

The inventors have also discovered that major improvements in corrosion resistance, rust inhibition, and adherence for paint and the like, are obtained when manganese-nitrogen compounds, e.g., manganese nitride and the like, are present along with manganese phosphate in the conversion coating formed on the surface of magnesium-containing metal.

The presence of these compounds in the conversion coating of the invention can be determined by X-ray diffraction (Hanawalt method: comparison of the X-ray diffraction angles and intensities with Joint Committee on Powder Diffraction Standards ("JCPDS") cards).

The conversion treatment bath composition according to the present invention should have a pH of 2.0 to 5.0. Etching by the phosphorus-containing acid is too severe when the pH is less than 2.0. This causes the adherence of smut on the resulting conversion coating, which reduces the improvement in its corrosion resistance, and causes large fluctuations in the bath. Etching by the phosphorus-containing acid is too weak at a pH above 5.0. This causes a thin conversion coating formation and prevents the appearance of the reticulating cracks, and thereby causes problems such as a reduction in the post-painting secondary adhesion and the like.

The conversion treatment bath composition of the invention may also contain one or more selections from the group comprising nitrate ions, sulfate ions, and fluorine-containing compounds. This component is used to optimize etching.

The conversion treatment bath composition of the invention may also contain ions or compounds of the content of Mg, Al, Zn, Ca, Ba, Sn, Zr, and Si. On the other hand, the content of Cu, Ni, and Fe is preferably kept as small as possible because these elements exercise a corrosion-accelerating activity on magnesium-containing metals. More particularly, independently for each component noted, the concentration in treatment baths according to the invention of each of copper, nickel, and iron preferably is, with increasing preference in the order given, not more than 0.1, 0.01, 0.005, 0.001, 0.0005, 0.0001, 0.00005, 0.00001, 0.000005, 0.000001, 0.0000005, or 0.0000001 g-a/L.

A method of the invention includes forming a conversion coating that contains phosphorus-manganese and manganese-nitrogen compounds on the surface of magnesium-containing metal by contacting the surface of said magnesium-containing metal with an aqueous conversion treatment bath that has a pH of 2.0 to 5.0 and contains phosphorus-containing acid, manganese ions, and amine(s). Network-forming or reticulating grooves (cracks) having widths of 0.1 to 2 micrometers are preferably produced in this conversion coating layer. These reticulating grooves in the conversion coating are believed to have an excellent anchoring effect for paint films and yield a major improvement in paint film adherence.

Conversion treatment according to the method of the present invention is generally done at a relatively low temperature of 20° C. to 65° C., and with a relatively short treatment time of 0.2 to 6 minutes; the time of contact preferably is, with increasing preference in the order given, at least 0.5, 1 or 2 min.

The method of the invention as described above can form conversion coatings with thicknesses of 0.1 to 3.0 micrometers, and these conversion coatings appear amorphous in character to visual examination, even at a magnification of 1000×. However, as noted below, the coatings produce X-ray diffraction patterns indicative of some microcrystallinity.

Pretreatment of the magnesium-containing metal prior to application of the conversion treatment of the invention may include an alkali etch in addition to the usual cleaning procedures. This alkali etch preferentially removes alloy components, such as Al, Zn, and so forth, that segregate onto the surface of magnesium-containing metals, and thus supports a smooth and efficient etch of the magnesium during conversion treatment and thereby accelerates formation of the conversion coating. In addition, the alkali etch functions to increase the paint adherence of the conversion coating by suppressing the bath fluctuations and smut formation that arise due to elution of Al, Zn, and so forth, into the conversion treatment bath.

The invention is illustrated in greater detail hereinafter through working examples; however, the scope of the invention is not limited to the following examples.

EXAMPLES

Example 1

The surface of magnesium alloy sheet (type AZ91) was cleaned and subjected to the following treatments.

1. Preparation of the conversion treatment bath

An aqueous solution was prepared that contained 25 grams per liter (here-inafter usually abbreviated as "g/L") of 85 % by weight orthophosphoric acid in water, 25 g/L of manganese dihydrogen phosphate tetrahydrate, and 20 g/L of triethylamine, with the balance being water. Its pH was 3.0.

2. Conversion treatment

The specified magnesium alloy sheet was immersed in the aforementioned conversion treatment bath for 3 minutes at 40° C. to 45° C. It was then withdrawn, washed with water, and dried.

3. Tests on the conversion coating (i) Inspection of the conversion coating

Using a microscope at 1000×, the surface of the conversion coating was evaluated for the presence and magnitude of occurrence of reticulating grooves (cracks) and smut.

(a) Evaluation scale for the reticulating grooves (cracks)

| | |
|---|---|
| ++ | presence of distinct reticulating grooves having widths of 0.1 to 2 micrometers |
| + | presence of incomplete reticulating grooves having widths of 0.1 to 0.5 micrometers |
| x | absence of reticulating grooves, presence of a porous state |

(b) Status of smut formation

| | |
|---|---|
| ++ | no smut formation |
| + | formation of a relatively small amount of smut |
| x | distinct smut formation |

(ii) The phosphorus and manganese in the conversion coating were quantitatively analyzed by X-ray fluorescence (hereinafter usually abbreviated as "XRF").

(iii) Presence of nitrogen compounds in the conversion coating

The diffraction angles and intensities determined in X-ray diffraction were compared with JCPDS cards (Hanawalt method).

4. Painting

A solvent-based acrylic paint (Saguran #3000 from Asahi Solvent Company) was sprayed onto the conversion coating—formed as described above —on magnesium alloy sheet as described above (one coat, one bake, paint film thickness=20 micrometers).

5. Salt-spray testing (hereinafter usually abbreviated as "SST")

A cross was scribed into the painted panel obtained as described above, and salt-spray testing in accordance with JIS Z 2371 was then run on the panel.

spray time: 120 hours number of test panels: 50

After the exposure to salt spray, the larger of the blister width at the cross cut and the peel width at the cross cut after tape peeling was selected and measured.

6. Water resistance tests

Checkerboard testing was conducted according to JIS K 5400.

temperature: 40° C.

time: 120 hours number of test panels: 50

After exposure to the test conditions, the appearance and secondary adherence were evaluated as described below.

(a) External appearance

| | |
|---|---|
| ++ | no blistering |
| + | minor blistering |
| x | blistering |

(b) Secondary adherence

A 100-cell grid (10×10×1 mm) was executed according to JIS K 5400, and the number of residual cells after tape peeling was measured.

Comparative Example 1

Treatment was conducted as in Example 1, except that the conversion treatment bath contained 20 g/L of 85% orthophosphoric acid and 20 g/L of triethylamine and did not contain manganese dihydrogen phosphate, and its pH was 5.0.

Comparative Example 2

Treatment was conducted as in Example 1, except that the conversion treatment bath contained 25 g/L of 85% orthophosphoric acid and 25 g/L of manganese dihydrogen phosphate tetrahydrate and did not contain triethylamine, and its pH was 2.0.

The test results from Example 1 and Comparative Examples 1 and 2 are reported in Table 1.

TABLE 1

CHARACTERISTICS OF THE CONVERSION COATINGS, PAINT PERFORMANCE, AND OVERALL EVALUATION FOR EXAMPLE 1 AND COMPARATIVE EXAMPLES 1 AND 2

| Characteristic Measured: | | Value or Rating of Characteristic for: Example 1 | Comp. Ex. 1 | Comp Ex. 2 |
|---|---|---|---|---|
| Appearance: | Reticulation | ++ | x | ++ |
| | Smut | ++ | ++ | x |
| mg/m$^2$ in | P | 186 | 230 | 620 |
| Coating of: | Mn | 76 | — | 132 |
| Nitrogen Compound In Coating? | | Yes | No | No |
| Water Resistance Test Results: | Appearance | ++ | x | x |
| | Sec. Adhesion | 100 | 30–40 | 50–80 |
| Salt Spray Test Result, mm | | 1.0–1.5 | 2.0–4.0 | 2.0–3.0 |
| Overall Evaluation | | Excellent | Poor | Poor |

Notes for Table 1 "Comp. Ex." means "Comparative Example". The nitrogen compound indicated by X-ray diffraction in the coating formed in the Example was manganese nitride. "Sec." means "Secondary", and the values reported for secondary adhesion are the number of squares, out of a total of 100 originally, to which paint remained adhered after peeling; therefore, higher values are preferred.

Comparative Example 3, Example 2. and Comparative Example 4

Comparative Example 3, Example 2, and Comparative Example 4 were performed according to the procedure of Example 1, except that the conversion treatment bath compositions were changed as shown in Table 2. Results from these examples are shown in Table 3.

TABLE 2

COMPOSITION OF CONVERSION TREATMENT BATHS

| Characteristic: | Comp. Ex. 3 | Example 2 | Comp. Ex. 4 |
|---|---|---|---|
| g/L of 85% $H_3PO_4$ | 25 | 35 | 25 |
| g/L of $Mn(H_2PO_4)_2.4H_2O$ | 1.0 | 35 | 2.0 |
| g/L of Triethylamine | 1.0 | 28 | 24 |
| pH | 1.5 | 3.0 | 5.5 |

Notes for Table 2 "Comp. Ex." means Comparative Example. The balance of the treatment bath not shown was water.

TABLE 3

CHARACTERISTICS OF THE CONVERSION COATINGS, PAINT PERFORMANCE, AND OVERALL EVALUATION FOR EXAMPLE 2 AND COMPARATIVE EXAMPLES 3 AND 4

| Characteristic Measured: | | Value or Rating of Characteristic for: Example 2 | Comp. Ex. 3 | Comp Ex. 4 |
|---|---|---|---|---|
| Appearance | Reticulation | ++ | ++ | x |
| | Smut | ++ | x | ++ |
| mg/m$^2$ in | P | 286 | 477 | 85 |
| Coating of: | Mn | 115 | 4 | 7 |
| Nitrogen Compound in Coating? | | Yes | No | Uncertain |
| Water Resistance Test Results | Appearance | ++ | x | x |
| | Sec. Adhesion | 100 | 60 | 10 |
| | Adhesion | | | |
| Salt Spray Test Result, mm | | 1.0 | 2.5 | 3.5 |
| Overall Evaluation | | Excellent | Poor | Poor |

Notes for Table 3 The notes for Table 1 also apply to this table.

Benefits of the Invention

The present invention produces a highly corrosion-resistant, highly rust-inhibiting, and strongly paint-adherent conversion coating on the surface of magnesium-containing metals, and does so rapidly and at relatively low temperatures, using a substantially chromium-free conversion treatment bath.

We claim:

1. An aqueous liquid composition that is suitable, optionally after being diluted with water, for treating magnesium-containing metal surfaces to form a conversion coating thereon, said aqueous liquid composition having a pH in the range from 2.0 to 5.0 and a concentration of phosphorus in g-a/L and comprising water and:

(A) an amount of a component of phosphorus-containing inorganic acid(s);

(B) an amount of a component of divalent manganese cations: and (C) an amount of a component of organic amines.

2. A composition according to claim 1, wherein component (C) is selected from the group consisting of aliphatic amines, heterocyclic amines, and aromatic amines, all of said amines being soluble to the extent of at least 1% by weight at 25° C. in an aqueous solution having a pH from 2.0 to 5.0.

3. A composition according to claim 2, wherein component (A) consists of orthophosphoric acid and component (B) is provided by dissolving manganese dihydrogen phosphate, manganese hydrogen phosphate, or both in water to form the composition.

4. A composition according to claim 3, wherein: the amount of component (B) corresponds to a concentration of manganese in g-a/L that has a ratio to the concentration of phosphorus in g-a/L that is from 0.16 to 0.26 and the amount of component (C) corresponds to a concentration of amine in M that has a ratio to the concentration of manganese in g-a/L that is from 2.00 to 3.0.

5. A composition according to claim 2, wherein: the amount of component (B) corresponds to a concentration of manganese in g-a/L that has a ratio to the concentration of phosphorus in g-a/L that is from 0.10 to 0.30 and the amount of component (C) corresponds to a concentration of amine in M that has a ratio to the concentration of manganese in g-a/L that is from 1.40 to 3.5.

6. A composition according to claim 1, wherein: the amount of component (B) corresponds to a concentration of manganese in g-a/L that has a ratio to the concentration of phosphorus in g-a/L that is from 0.04 to 1.0 and the amount of component (C) corresponds to a concentration of amine in M that has a ratio to the concentration of manganese in g-a/L that is from 1.0 to 4.5.

7. A composition according to claim 6, wherein: the concentration of phosphorus is from 0.08 to 1.2 g-a/L; the concentration of manganese in g-a/L is from 0.030 to 0.4 g-a/L; and the concentration of amine in M is from 0.030 to 0.90.

8. A composition according to claim 5, wherein: the concentration of phosphorus is from 0.16 to 1.0 g-a/L; the concentration of manganese in g-a/L is from 0.055 to 0.25 g-a/L; and the concentration of amine in M is from 0.090 to 0.50.

9. A composition according to claim 4, wherein: the concentration of phosphorus is from 0.35 to 0.55 g-a/L; the concentration of manganese in g-a/L is from 0.074 to 0.15 g-a/L; and the concentration of amine in M is from 0.150 to 0.240.

10. A composition according to claim 3, wherein: the concentration of phosphorus is from 0.35 to 0.55 g-a/L; the concentration of manganese in g-a/L is from 0.074 to 0.15 g-a/L; and the concentration of amine in M is from 0.150 to 0.240.

11. A composition according to claim 2, wherein: the concentration of phosphorus is from 0.16 to 1.0 g-a/L; the concentration of manganese in g-a/L is from 0.055 to 0.25 g-a/L; and the concentration of amine in M is from 0.090 to 0.50.

12. A composition according to claim 1, wherein: the concentration of phosphorus is from 0.08 to 1.2 g-a/L; the concentration of manganese in g-a/L is from 0.030 to 0.4 g-a/L; and the concentration of amine in M is from 0.030 to 0.90.

13. An article of manufacture having at least one area of outer surface that is a conversion coating that contains (i) phosphorus-maganese compounds and (ii) at least one of manganese-nitrogen and other nitrogen compounds, said conversion coating overlying and having being formed by contacting, with a composition according to claim 1, a metallic body that contains at least 55% by weight of magnesium.

14. An article of manufacture according to claim 13, wherein said conversion coating contains from 1 to 500 $mg/m^2$ of manganese and from 1 to 1000 $mg/M^2$ of phosphorus and also contains a large number of reticulating cracks having widths of 0.1 to 2 micrometers.

* * * * *